US010760010B2

(12) United States Patent
Dugas et al.

(10) Patent No.: US 10,760,010 B2
(45) Date of Patent: Sep. 1, 2020

(54) METHODS AND SYSTEMS TO SEPARATE HYDROCARBON MIXTURES SUCH AS NATURAL GAS INTO LIGHT AND HEAVY COMPONENTS

(71) Applicant: Dow Global Technologies LLC, Midland, MI (US)

(72) Inventors: Ross E. Dugas, Lake Jackson, TX (US); Zubin B. Kuvadia, Lake Jackson, TX (US); Preshit Dandekar, Seattle, WA (US); German A. Oliveros Patino, Lake Jackson, TX (US)

(73) Assignee: Dow Global Technologies LLC, Midland, MI (US)

( * ) Notice: Subject to any disclaimer, the term of this patent is extended or adjusted under 35 U.S.C. 154(b) by 0 days.

(21) Appl. No.: 16/451,831

(22) Filed: Jun. 25, 2019

(65) Prior Publication Data

US 2020/0002628 A1 Jan. 2, 2020

Related U.S. Application Data

(60) Provisional application No. 62/693,094, filed on Jul. 2, 2018.

(51) Int. Cl.

| | |
|---|---|
| ***C10G 53/08*** | (2006.01) |
| ***C10L 3/10*** | (2006.01) |
| ***C10G 5/06*** | (2006.01) |
| ***C10G 5/02*** | (2006.01) |

(52) U.S. Cl.

CPC ..... *C10G 53/08* (2013.01); *C10G 5/02* (2013.01); *C10G 5/06* (2013.01); *C10L 3/10* (2013.01); *C10G 2300/1025* (2013.01); *C10L 2290/542* (2013.01); *C10L 2290/543* (2013.01)

(58) Field of Classification Search

CPC .. C10G 2300/1025; C10G 53/08; C10G 5/02; C10G 5/06; C10L 2290/542; C10L 2290/543; C10L 3/10; B01D 2256/245; B01D 2257/7022; B01D 2257/80; B01D 45/00; B01D 53/002

See application file for complete search history.

(56) References Cited

U.S. PATENT DOCUMENTS

| | | | | |
|---|---|---|---|---|
| 9,908,079 | B2 | 3/2018 | Rodgers et al. | |
| 2006/0191410 | A1* | 8/2006 | Dolan | B01D 53/047 95/96 |
| 2012/0222552 | A1* | 9/2012 | Ravikovitch | C01B 17/0408 95/97 |
| 2013/0186133 | A1* | 7/2013 | Ploeger | F25J 3/0209 62/636 |
| 2016/0001218 | A1 | 1/2016 | Rota | |

FOREIGN PATENT DOCUMENTS

| | | | |
|---|---|---|---|
| EP | 1 811 011 | A1 | 7/2007 |
| WO | 2015018333 | A1 | 2/2015 |
| WO | 2015130338 | A1 | 9/2015 |
| WO | 2015130339 | A1 | 9/2015 |
| WO | 2018085076 | A1 | 5/2018 |

OTHER PUBLICATIONS

F. Mueller, "Fundamentals of Gas Solids/Liquids Separation," Mueller Environmental Designs, Inc., Houston, TX, http://www.muellerenvironmental.com/res/uploads/media//200-059-GMRC-2004-Separation.pdf, retrieved on Jun. 12, 2018, 15 pgs.

* cited by examiner

*Primary Examiner* — Sharon Pregler

(57) ABSTRACT

The present invention integrates adsorption and liquefaction techniques to separate hydrocarbon feed mixtures into light and heavy components. A feed is partially liquefied in two or more stages. A first stage occurs at higher pressure. A second stage occurs at lower pressure. At each stage, gas and liquid components are separated. The separated heavy components resulting from liquefaction provide a purified natural gas liquid product. The separated gas components may be further processed and/or handled to provide purified natural gas. Heavy streams resulting from the further processing of the separated gas streams may be recycled and incorporated into the feed mixture. By using separate liquefaction stages at different pressures to favor C1 and then C2 separation from the heavy stream, a natural gas liquid product with high C3+ purity results.

19 Claims, 7 Drawing Sheets

Table 2: Material Balance for Example 1:

| | FEED | COMBFEED | 2 | 3 | 4 | 5 | 6 | OFFGAS | PSAFEED | TAIL | PRODUCT | NGL |
|---|---|---|---|---|---|---|---|---|---|---|---|---|
| Total Flow lbmol/hr | 230 | 310.6 | 310.6 | 310.6 | 310.6 | 144.6 | 166.0 | 38.1 | 144.5 | 42.5 | 102.1 | 127.9 |
| Total Flow tonne/day | 89.7 | 117.5 | 117.5 | 117.5 | 117.5 | 36.5 | 81.0 | 13.2 | 36.5 | 14.6 | 22.0 | 67.8 |
| Pressure psig | 2.9 | 2 | 170 | 165 | 155 | 155 | 155 | 5 | 155 | 2 | 130 | 5 |
| Temperature F | 86 | 78.6 | 120 | 109.5 | -10 | -10 | -10 | -56.8 | 118.9 | 110 | 86 | -56.8 |
| Mole Percent | | | | | | | | | | | | |
| C1 | 34.9% | 33.2% | 33.2% | 33.2% | 33.2% | 64.3% | 6.1% | 25.4% | 64.3% | 31.0% | 78.2% | 0.4% |
| C2 | 11.9% | 16.6% | 16.6% | 16.6% | 16.6% | 18.3% | 15.2% | 37.1% | 18.3% | 23.6% | 16.0% | 8.7% |
| C3 | 25.9% | 27.5% | 27.5% | 27.5% | 27.5% | 10.4% | 42.3% | 29.2% | 10.4% | 34.5% | 0.4% | 46.2% |
| C4 | 14.5% | 11.5% | 11.5% | 11.5% | 11.5% | 1.0% | 20.6% | 2.2% | 1.0% | 3.4% | 0.0% | 26.1% |
| C5 | 4.5% | 3.4% | 3.4% | 3.4% | 3.4% | 0.1% | 6.2% | 0.1% | 0.1% | 0.3% | 0.0% | 8.1% |
| C6 | 2.1% | 1.6% | 1.6% | 1.6% | 1.6% | 0.0% | 2.9% | 0.0% | 0.0% | 0.0% | 0.0% | 3.8% |
| CO2 | 2.3% | 2.7% | 2.7% | 2.7% | 2.7% | 3.9% | 1.6% | 4.9% | 3.9% | 2.6% | 4.4% | 0.7% |
| H2O | 3.4% | 3.2% | 3.2% | 3.2% | 3.2% | 1.3% | 4.9% | 0.9% | 1.3% | 4.2% | 0.1% | 6.2% |
| N2 | 0.4% | 0.4% | 0.4% | 0.4% | 0.4% | 0.7% | 0.1% | 0.2% | 0.7% | 0.4% | 0.9% | 0.1% |

Fig. 7

METHODS AND SYSTEMS TO SEPARATE HYDROCARBON MIXTURES SUCH AS NATURAL GAS INTO LIGHT AND HEAVY COMPONENTS

PRIORITY

The present nonprovisional patent application claims priority under 35 U.S.C. § 119(e) from United States Provisional patent application having Ser. No. 62/693,094, filed on Jul. 2, 2018, by Dugas et al. and titled METHODS AND SYSTEMS TO SEPARATE HYDROCARBON MIXTURES SUCH AS NATURAL GAS INTO LIGHT AND HEAVY COMPONENTS, wherein the entirety of said provisional patent application is incorporated herein by reference for all purposes.

FIELD OF THE INVENTION

The present invention relates to methods and systems to separate hydrocarbon mixtures such as natural gas into light and heavy components using a combination of adsorption and liquefaction (gas-liquid) separation techniques. More particularly, the present invention relates to such technology wherein the liquefaction separation treats the heavy stream at two or more pressure regimes to selectively favor separation between C1 and C3 hydrocarbons, respectively.

BACKGROUND OF THE INVENTION

Natural gas is a naturally occurring hydrocarbon gas mixture. Natural gas includes mainly saturated hydrocarbon components such as methane, ethane, propane, butane, and heavier hydrocarbons. Natural gas typically contains about 60 to 100 mole percent methane based on the total hydrocarbon content, with the balance of the hydrocarbon content being primarily heavier alkanes. Alkanes of increasing carbon number are normally present in decreasing amounts. The components of natural gas have many uses. For example, these can be used as a source of energy for heating, cooking, electricity, and pressure generation. The components also may be used as chemical feedstock in the manufacture of other chemicals, as fertilizers, as animal and fish feed, and the like. However, the components often are separated in order to be more suitable for a desired use.

"Raw natural gas" refers herein to natural gas as obtained from natural sources. In addition to hydrocarbons, raw natural gas may include other constituents including one or more of carbon dioxide, water, nitrogen, hydrogen sulfide, mercaptans, mercury, chlorides, helium, or the like. In some applications, these additional constituents are undesirable contaminants and are removed in order to convert the natural gas into one or more useable products. In many desirable modes of practice, raw natural gas is treated using one or more purification processes in order to remove one or more of such contaminants to a desired degree. As used herein, the term "natural gas" will refer to raw natural gas that comprises at least one of C1 and/or C2 hydrocarbons as well as one or more C3+ hydrocarbons and that has been treated to remove at least a portion of one or more contaminants.

It is often desirable to separate natural gas into one or more light components (e.g., enriched in one or more C1 and/or C2 hydrocarbons) or heavy components (e.g., enriched in one or more C3+ hydrocarbons referred to herein as "natural gas liquid" materials). For example, it is financially desirable to recover natural gas liquids from natural gas to be used as petrochemical feedstocks where they have a higher value as compared to their value as a fuel gas component. Another reason is to meet pipeline specifications or liquefied natural gas (LNG) specifications for heating value, dew point, and condensation.

Moreover, oilfields are often located in remote locations where power grids have not yet been developed and electrical power is not available. For example, fuels such as diesel may be needed to run onsite oilfield equipment at remote locations. While natural gas is often readily available in such remote locations, the use of raw gas is not feasible unless a sufficient amount of the natural gas liquids have first been removed. Otherwise, natural gas containing too much NGL content may have elevated BTU levels and may not be suitable for gas combustion systems that are designed to operate within a narrow BTU range. Using a natural gas with too high of BTU level may require higher maintenance costs, higher operating temperatures, reduced equipment life expectancy, decreased power reduction, and/or generate increased pollution if operated at higher BTUs.

Many techniques for separating natural gas into desired components are known. Techniques include adsorption, gas-liquid separation, and combinations of these. Pressure swing adsorption (PSA) is one exemplary separation technique. In a conventional PSA process, an adsorbent is used that selectively adsorbs higher molecular weight hydrocarbons relative to methane and ethane under an elevated pressure, but then will readily release the adsorbed material when the pressure is reduced. This allows lighter components to be recovered in a first stage while heavier components are adsorbed under pressure. In a second stage, the heavier components can be separately recovered by releasing the pressure, which also regenerates the adsorbent for further use.

Adsorption techniques may be used in combination with other separation strategies in order to more effectively separate hydrocarbon mixtures into light and heavy components. Such integrated separation systems may integrate adsorption strategies with gas-liquid or liquefaction separation strategies. Liquefaction (gas-liquid) separation strategies generally involve partially liquefying a hydrocarbon mixture so that some of the NGLs are condensed to separate them from lighter components in a gas phase.

Thus, a goal of natural gas separation is to obtain both a highly purified natural gas product containing predominantly C1 and/or C2 hydrocarbon material and a purified NGL product containing predominantly C3+ hydrocarbon material. However, it has been difficult to use liquefaction strategies to remove both C1 and C2 hydrocarbon material from the heavy stream. The result is that the heavy stream may include too much C2 content such that the C3+ hydrocarbon content remains more dilute than desired. Improved strategies to recover more concentrated heavy streams that are more easily resolved from both C1 and C2 hydrocarbon materials are desired.

SUMMARY OF THE INVENTION

The present invention provides strategies to integrate adsorption and liquefaction techniques to separate hydrocarbon feed mixtures into purified light and heavy components, respectively. Advantageously, the present invention improves the ability of liquefaction to resolve C1 and C2 hydrocarbons from C3+ hydrocarbons in order to recover high yields of the C3+ hydrocarbons in a purified NGL product. One aspect of the strategy is to initially practice a gas liquid separation of a heavy stream at an elevated pressure effective to help resolve the liquid heavy stream from methane gas. The rejected methane component, which generally will include some rejected C2 and C3+ material can be further processed using adsorption techniques to further purify the light component. A further aspect of the strategy is then to practice at least one additional gas liquid separation of the heavy stream at a lower pressure effective to help resolve the liquid heavy stream from C2 gas. The rejected C2 component, which generally will include some rejected C1 and C3+ material, can then be recycled back into the feed mixture for reprocessing, combined with the methane-rich stream obtained from the previous gas-liquid separation, and/or used as all or a portion of a light hydrocarbon product. By using separate liquefaction stages at different pressures to favor C1 and then C2 separation from the heavy stream, a heavy stream with high C3+ purity results with a reduced equipment cost.

In one aspect, the present invention relates to a method of separating C1 and/or C2 hydrocarbons from one or more C3+ hydrocarbons, comprising the steps of:

a) providing a feed mixture comprising (i) at least one of C1 and/or C2 hydrocarbons, and (ii) one or more C3+ hydrocarbons;

b) pressuring and cooling the feed mixture to provide a partially liquefied feed mixture comprising a first liquid portion that is enriched in C3+ hydrocarbons relative to the feed mixture and a first gas portion that is enriched in C1 and/or C2 hydrocarbons relative to the feed mixture;

c) at least partially separating the first liquid portion from the first gas portion to provide a separated first liquid portion and a separated first gas portion;

d) reducing the pressure of the separated first liquid portion to further separate the separated first liquid portion into a second liquid portion that is enriched in C3+ hydrocarbons relative to the separated first liquid portion and a second gas portion that is enriched in C1 and/or C2 hydrocarbons relative to the separated first liquid portion;

e) using at least one adsorbent to further separate the separated first gas portion into a light component that is enriched in C1 and/or C2 hydrocarbons relative to the separated first gas portion and a heavy component that is enriched in at least one C3+ hydrocarbon relative to the separated first gas portion;

f) incorporating at least a portion of the heavy component from step e) into the feed mixture; and g) incorporating at least a portion of the separated second liquid portion from step c) into a natural gas liquid composition that is enriched in at least one C3+ hydrocarbon relative to the feed mixture; and h) incorporating at least a portion of the separated light component from step c) into a natural gas composition that is enriched in one or more C1 and/or C2 hydrocarbons relative to the feed mixture.

In one aspect, the present invention relates to a method of separating C1 and/or C2 hydrocarbons from one or more C3+ hydrocarbons, comprising the steps of:

a) providing a feed mixture comprising (i) at least one of C1 and/or C2 hydrocarbons, and (ii) one or more C3+ hydrocarbons;

b) pressuring and cooling the feed mixture to provide a partially liquefied feed mixture comprising a first liquid portion that is enriched in C3+ hydrocarbons relative to the feed mixture and a first gas portion that is enriched in C1 and/or C2 hydrocarbons relative to the feed mixture;

c) using one or more gas/liquid separations to separate the partially liquefied feed mixture into at least one separated liquid portion that is enriched in C3+ hydrocarbons relative to the feed mixture and at least one separated gas portion that is enriched in C1 and/or C2 hydrocarbons relative to the feed mixture;

d) using at least one adsorbent to contact at least one separated gas portion to further separate said at least one separated gas portions contacting the adsorbent into a light component that is enriched in C1 and/or C2 hydrocarbons relative to the separated gas portion contacting the adsorbent and a heavy component that is enriched in at least one C3+ hydrocarbon relative to the separated gas portion contacting the adsorbent;

e) incorporating at least a portion of the heavy component into the feed mixture;

f) incorporating at least a portion of the separated liquid portion from step c) into a natural gas liquid composition that is enriched in at least one C3+ hydrocarbon relative to the feed mixture; and g) incorporating at least a portion of the separated light component from step d) into a natural gas composition that is enriched in one or more C1 and/or C2 hydrocarbons relative to the feed mixture.

In another aspect, the present invention relates to a system for separating C1 and/or C2 hydrocarbons from one or more C3+ hydrocarbons, comprising:

a. a source comprising a feed mixture, wherein the feed mixture comprises (i) one or more C1 and/or C2 hydrocarbons; and (ii) one or more C+ hydrocarbons;

b. a liquefaction system fluidly coupled to the source in a manner such that the feed mixture is supplied to the liquefaction system, wherein the liquefaction system is configured to separate the feed mixture into at least one separated liquid portion that is enriched in C3+ hydrocarbons relative to the feed mixture and at least one separated gas portion that is enriched in C1 and/or C2 hydrocarbons relative to the feed mixture;

c. an adsorbent bed system comprising one or more adsorbent beds, each adsorbent bed comprising one or more adsorbents that are caused under pressure to selectively adsorb C3+ hydrocarbons relative to C1 and/or C2 hydrocarbons from a flowing stream comprising C1 and/or C2 hydrocarbons and C3+ hydrocarbons, wherein the adsorbent bed system comprises:

i. a first configuration that occurs under a first pressure such that the flowing stream is separated into at least one C1 and/or C2 enriched output stream while one or more C3+ enriched portions of the flowing stream are selectively adsorbed onto at least one adsorbent bed; and ii. a second configuration occurring under a reduced pressure relative to the first pressure such the one or more adsorbed C3+ portions of the flowing stream are released from at least one of the one or more adsorbent beds to provide at least one C3+ enriched tail stream;

d. a first pathway that couples the liquefaction system to the adsorbent bed system in a manner such that the liquefaction system is upstream from the adsorbent bed system and such that at least a portion of at least one separated gas portion is supplied from the liquefaction system to the adsorbent bed system; and e. a second pathway that couples the adsorbent bed system to the liquefaction system in a manner such that the adsorbent bed system is upstream from the liquefaction system and such that at least a portion of the at least one C3+ enriched tail stream is incorporated into the feed mixture supplied to the liquefaction system.

BRIEF DESCRIPTION OF THE DRAWINGS

FIG. 7 is a table of calculated data showing a material balance when an illustrative, hypothetical feed mixture is separated into purified light and heavy components by practicing the method of FIG. 1 in the system of FIG. 4.

DETAILED DESCRIPTION OF PRESENTLY PREFERRED EMBODIMENTS

Figure 1:
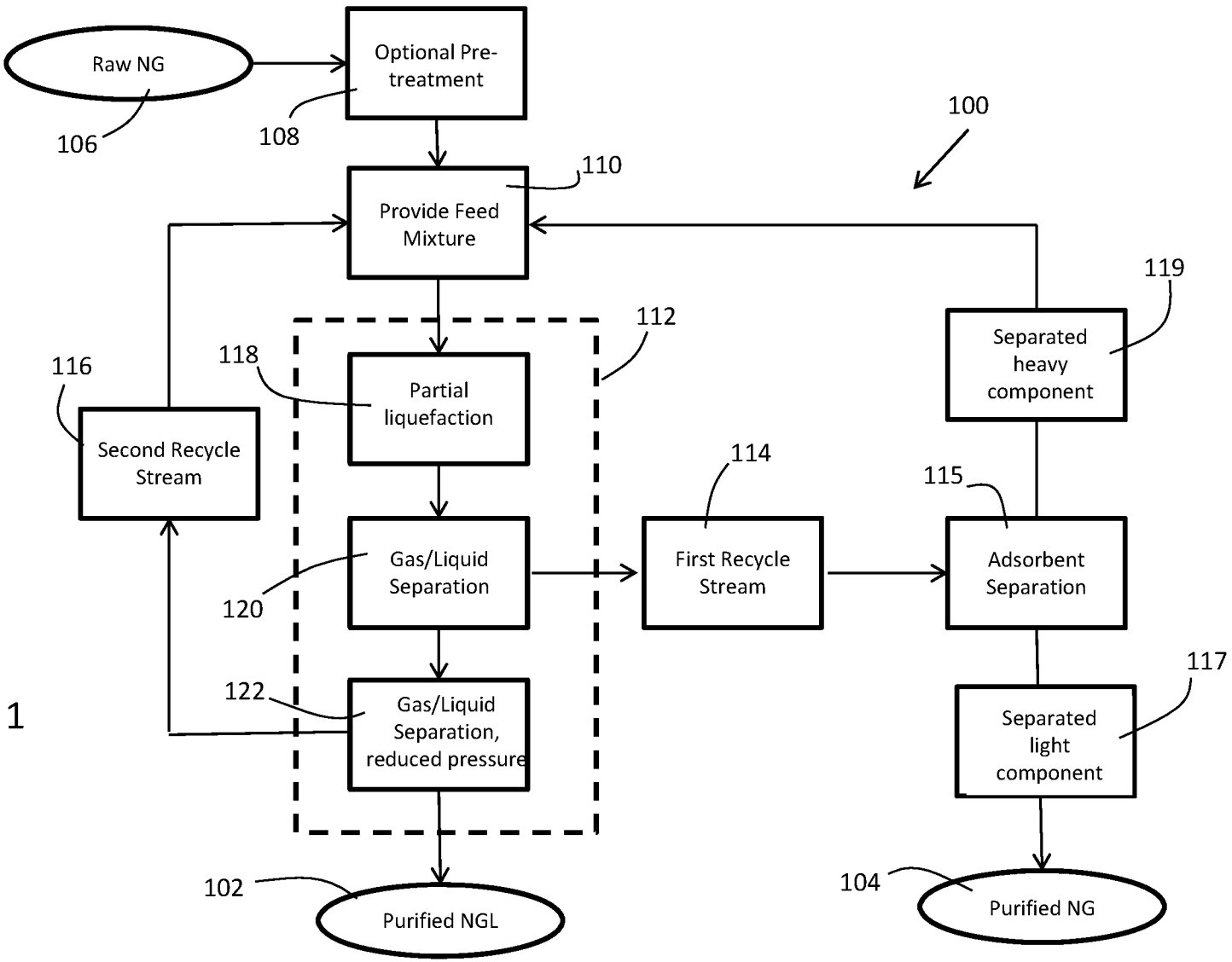
FIG. 1 is a schematic illustration of one embodiment of a method of the present invention useful to separate hydrocarbon feed mixtures into purified light and heavy components, respectively.

The present invention will now be further described with reference to the following illustrative embodiments. The embodiments of the present invention described below are not intended to be exhaustive or to limit the invention to the precise forms disclosed in the following detailed description. Rather a purpose of the embodiments chosen and described is so that the appreciation and understanding by others skilled in the art of the principles and practices of the present invention can be facilitated.

The present invention provides methods and systems for separating C1 and/or C2 hydrocarbons from one or more C3+ hydrocarbons in hydrocarbon feed mixtures. The present invention may be used for separations for a wide range of mixtures including C1 and/or C2 hydrocarbons as well as C3+ hydrocarbons. Exemplary embodiments of such mixtures may contain from 5 to 95 moles of C1 and/or C2 hydrocarbons per 5 to 95 moles of C3+ hydrocarbons. The present invention is particularly useful to separate mixtures containing 5 to 40, preferably 10 to 35, more preferably 15 to 30 moles of C3+ hydrocarbons per 80 to 100 moles of C1 and/or C2 hydrocarbons. All amounts of materials herein are on a mole basis unless otherwise expressly stated. As used herein, mole percent is based on the total moles of hydrocarbons unless otherwise expressly stated. The principles of the present invention are advantageously used with respect to natural gas as all or part of the feed mixture.

As used herein, a "hydrocarbon" is an organic compound formed entirely from hydrogen and carbon atoms. Hydrocarbons include alkanes, alkenes, alkynes, and aromatic compounds. Hydrocarbons may be linear, branched, and/or cyclic. Some cyclic embodiments may include bridge moieties or spyro carbon moieties. Cyclic embodiments of alkanes may be referred to as cycloalkanes. Aromatic hydrocarbons may include one or more aromatic rings. When an aromatic hydrocarbon includes two or more rings, these may be fused (e.g., naphthalene as one example) or linked by a single bond (e.g., biphenyl as one example) or a suitable divalent hydrocarbon linking group (e.g., diphenylmethane as one example).

A hydrocarbon or group of hydrocarbons may be referred to by the designation C(N), where C is a symbol representing carbon and (N) is a number indicating the number of carbon atoms in the hydrocarbon or group of hydrocarbons. For example, C1 refers to methane, the smallest hydrocarbon having one carbon atom. C2 refers to hydrocarbons with 2 carbon atoms such as ethane, ethene, and ethyne. C3 refers to hydrocarbons with 3 carbon atoms, etc. Polymeric hydrocarbons such polyethylene, polypropylene, polystyrene, ultrahigh molecular weight polyethylene, and the like may have large (N) values including but not limited to (N) values in the range from 50 to 100,000 or even higher. This designation approach also may be used to refer to hydrocarbons having carbon atoms in a range. For example, the designations C1-4 or C1 to C4 both refer to hydrocarbons having from 1 to 4 carbon atoms. As another example, the designation C(N)+ refers to hydrocarbons having N or more carbon atoms. According to this kind of designation, C3+ refers to hydrocarbons having 3 or more carbon atoms. The present invention is particularly useful for separating C1 and/or C2 hydrocarbons from C3+ hydrocarbons.

One commercially important practice involves separating natural gas into a light hydrocarbon component and a heavy hydrocarbon component, respectively. As used herein, the term "light" with respect to a hydrocarbon processing refers to a component (which may be a batch or stream) that contains an enriched C1 and/or C2 hydrocarbon content and that was obtained from a hydrocarbon feed mixture comprising C1 and/or C2 hydrocarbons as well as one or more C3+ hydrocarbons. Desirably, the C3+ content in such light hydrocarbon components is less than 10 mole percent, more desirably less than 5 mole percent, or even more desirably less than 2 mole percent. As used herein, the term "treated gas" shall also be used to refer to a light component separated from a hydrocarbon mixture. The term "heavy" with respect to hydrocarbon processing refers to a component that comprises one or more enriched C3+ hydrocarbons and that was obtained from a hydrocarbon feed mixture comprising C1 and/or C2 hydrocarbons as well as one or more C3+ hydrocarbons. Desirably, the C1 and C2 content in such a purified heavy hydrocarbon component is less than 30 mole percent, even less than 25 mole percent, even less than 20 mole percent, even less than 15 mole percent, or even less than 10 mole percent of C1 and C2 hydrocarbons. Advantageously, the present invention provides methods and systems to separate natural gas mixtures into such heavy and light components.

In the natural gas industry, the term "natural gas liquids" or "NGL" has been used to refer to the C2+ content of raw natural gas or natural gas. This approach to defining NGL implies a separation between C1 on the one hand, and C2+ hydrocarbons on the other hand. The present invention, in contrast, is particularly suitable for separating C1 and C2 hydrocarbons as the light component from C3+ hydrocarbons as the heavy component. Accordingly, in the practice of the present invention, the terms "natural gas liquids" or "NGL" or "heavy" shall refer to a heavy component comprising C3+ hydrocarbons that is separated from a hydrocarbon mixture comprising C1 and/or C2 hydrocarbons as well as one or more C3+ hydrocarbons. According to such terminology, the present invention allows raw natural gas or natural gas to be separated into purified treated gas on the one hand and purified natural gas liquids on the other hand.

The term "enriched" is used herein to refer to the purification of one or more components of a hydrocarbon mixture. The term "enriched" means that the concentration of the component(s) is higher in the separated component relative to the mixture that was treated to produce the separated component. For example, when a feed mixture containing 80 mole percent C1 and C2 hydrocarbons and 20 mole percent C3+ hydrocarbons is separated into a light component containing 98 mole percent C1 and C2 hydrocarbons and 2 mole percent C3+ hydrocarbons, the light component is enriched with respect to the C1 and C2 hydrocarbons. Additionally, the C1 and C2 hydrocarbons are also described as being purified in the light stream. In the meantime, the C3+ content of the light component can be described as being "depleted" as compared to the C3+ content of the mixture that was treated to provide the separated light component. Similarly, if the same feed mixture is processed to produce a heavy component containing 70 mole percent C3+ hydrocarbons and 30 mole percent C1 and C2 hydrocarbons, then the heavy component is enriched or purified with respect to C3+ hydrocarbons. In the meantime, the C1 and C2 content of the light component can be described as being "depleted" as compared to the C1 and C2 content of the mixture that was treated to provide the separated heavy component. The principles of the present invention enrich or purify the heavy component of hydrocarbon mixtures in stages to provide a purification strategy that overall is effective at purifying the heavy component in an economical manner with high yield while at the same time producing a highly pure light component with high yield.

Hydrocarbons may be gases, liquids, or solids at standard temperature and pressure (referred to as "STP" conditions, which are 25° C. and 1 atm absolute). For example, methane, ethane and propane are gases at STP conditions. Hexane and benzene are examples of hydrocarbons that are liquids at STP conditions. Waxes (paraffin wax and naphthalene, for instance) and polymers such us polyethylene, polypropylene, and polystyrene are examples of hydrocarbons that are solids at STP conditions.

Adjusting temperature and pressure of a hydrocarbon mixture can allow hydrocarbons that are gases at STP conditions to be in liquid form. The technique of using cooling and/or pressure to help resolve hydrocarbon mixtures work, at least in part, by partially liquefying the mixtures. Such liquefaction causes the heavier species to be in liquid form, while the lighter species tend to be in gas form. For example, chilling and pressurizing a hydrocarbon mixture can be practiced so that hydrocarbons with 3 or more carbon atoms can be caused to be predominantly in liquid form while hydrocarbons with 1 or 2 carbon atoms remain predominantly in gas form. Because gases and liquids are easy to separate using gas/liquid separation techniques, partial liquefaction allows the smaller, lighter hydrocarbons such as methane, ethane, ethene, and ethyne in the gas phase to be separated from the heavier hydrocarbons having 3 or more carbon atoms in the liquid phase. In actual practice, the gas may include some C3+ content, but this tends to be depleted relative to the starting mixture that was separated. The liquid may include some C1 and/or C2 content, but this tends to be depleted relative to the starting mixture that was separated.

The present invention provides a method of separating C1 and/or C2 hydrocarbons from one or more C3+ hydrocarbons using systems and methods that integrate partial liquefaction techniques with adsorption techniques. The practice of the present invention provides highly purified light and heavy hydrocarbon products, respectively. For example, the present invention may be practiced so that the light hydrocarbon product is highly pure with respect to C1 and/or C2 content, containing less than 10 mole percent, or even less than 5 mole percent, or even less than 2 mole percent of C3+ hydrocarbons. At such a level of purity, the lighter stream is pure enough in C1 and/or C2 to be useable as a natural gas (NG) pipeline product. Such a natural gas product may be used in many ways. For example, the natural gas may be used as fuel to generate power or heat, as raw materials to prepare other compounds, or even flared in whole or in part if disposal is desired.

In the meantime, a further aspect of the present invention is to carry out liquefaction separation in multiple stages in combination with multiple recycling strategies to allow high levels of separation and usage as between the C1-C2 and C3+ content of the feed mixture being processed. For example, the resultant purified heavy component, which may be in the form of an NGL stream may include 80 to 95 moles of C3+ hydrocarbons per 5 to 20 moles of C1 and/or C2 hydrocarbons. In one mode of practice, a purified NGL stream includes 85 moles of C3+ hydrocarbons per 12 moles of C2 hydrocarbons, and 85 moles of C3+ hydrocarbons per 1.5 moles of C1 hydrocarbons.

FIG. 1 schematically shows an illustrative method 100 of the present invention for processing a feed mixture comprising C1 and/or C2 hydrocarbons as well as one or more C3+ hydrocarbons in order to separate the mixture into purified light and heavy components. Method 100 separates the C1 and C2 hydrocarbons from C3+ hydrocarbons into light hydrocarbon stream 104 containing purified natural gas (NG) and heavy hydrocarbon stream 102 containing purified natural gas liquid (NGL), respectively. For purposes of the present invention, FIG. 1 shows a raw natural gas stream provided in step 106 to be separated into the heavy and light hydrocarbon streams 102 and 104, respectively. In step 108, the raw natural gas stream optionally is subjected to one or more pre-treatments in order to remove one or more contaminants from the raw natural gas to a desired degree. The resultant natural gas is then incorporated into a feed mixture in step 110. At this early stage of processing, the feed mixture in step 110 comprises at least one of C1 and/or C2 hydrocarbons and one or more C3+ hydrocarbons. Often, the C3+ hydrocarbons include at least C3, C4, C5, and C6 hydrocarbons. Higher hydrocarbons, e.g., C7+ hydrocarbons, may also be present.

The present invention is particularly useful when the feed mixture provided in step 110 has a concentration of C3+ hydrocarbons that is sufficiently concentrated in C3+ content to be economically purified by using gas/liquid separation techniques upon the feed mixture directly. In such instances, an initial purification of the C3+ content is performed using one or more liquefaction separation techniques to undertake the initial purification. Desirably, a hydrocarbon mixture includes at least 15 to 20 or more moles of C3+ hydrocarbons per about 100 moles of C1 and/or C2 hydrocarbons in order to be more suitable for gas/liquid separation. Accordingly, method 100 practices an initial liquefaction separation in step 112 in order to provide a heavy hydrocarbon stream 102 that is purified with respect to one or more C3+ hydrocarbons and suitable for incorporation into a purified NGL product. A separated light component, withdrawn as a first recycle stream in step 114 as described further below, is then further processed in order to provide the purified light hydrocarbon stream 104 that is purified with respect to C1 and/or C2 hydrocarbons and is suitable for incorporation into an NG product.

In illustrative modes of practice, the initial separation practiced in step 112 involves using a liquefaction system to generate the purified heavy hydrocarbon stream 102 incorporating a purified NGL product as well as to provide first and second recycle streams in steps 114 and 116 for further processing. Step 112 incorporates a combination of partial liquefaction and gas/liquid separation steps 118, 120, and 122 in order to generate the heavy hydrocarbon stream 102 and recycle streams in steps 114 and 116. In step 118, the feed mixture obtained from step 110 is pressurized and cooled under conditions effective to partially liquefy the feed mixture so that a portion of the feed mixture is in the liquid phase and a portion of the feed mixture is in the gas phase. In some embodiments the liquefaction system includes an optional dehydration of water or other pretreatment (not shown) prior to cooling to achieve partial liquefaction.

As an initial aspect of step 112, the feed mixture is pressurized and cooled in a manner effective to partially liquefy the feed mixture in step 118. The feed mixture may be pressurized in one or more pressurizing stages to achieve the desired partial liquefaction. In illustrative embodiments, the feed mixture is pressurized to a pressure in the range from 20 psig to 500 psig, preferably 50 psig to 300 psig, more preferably 50 psig to 150 psig. Higher pressures can be used but are more costly.

The feed mixture may be cooled in one or more cooling stages to achieve the desired partial liquefaction. In illustrative embodiments, the feed mixture is cooled to a temperature in the range from −50° C. to 25, preferably −40° C. to 15° C., more preferably −30° C. to 0° C.

As a result of the partial liquefaction in step 118, the pressurized and cooled feed mixture includes at least one gas or vapor and at least one liquid. Generally, the gas is enriched in C1 and C2 hydrocarbons relative to the feed mixture as supplied to step 112, although some C3+ content may be in the gas phase. The C3+ content of the gas tends to be depleted with respect to the C3+ content of the feed mixture supplied to step 112. Similarly, the liquid is enriched in C3+ hydrocarbons relative to the feed mixture as supplied to step 112, although some C1 and C2 content may be in the liquid phase. The C1 and C2 content of the liquid tends to be depleted with respect to the C1 and C2 content of the feed mixture as supplied to step 112. This partial liquefaction allows the gas and liquid to be easily separated from each other.

Accordingly, a first gas/liquid separation (also known as vapor-liquid separation) is performed in step 120 in order to separate the liquid and gas of the partially liquefied tail stream. The gas and liquid separation may be accomplished using a variety of suitable techniques. According to one general method of operation, gravity is used to cause the liquid to settle toward the bottom of a suitable vessel, where the liquid can be withdrawn and supplied to step 122. In the meantime, the gas or vapor generally rises to the top of the vessel, where the gas or vapor can be withdrawn in step 114 as a first recycle stream. In addition to gravity, other separation forces may be used such as centrifugal force or the like. A variety of equipment to accomplish gas-liquid separation are known. Examples include flash drums, breakpots, knock-out drums, knock-out pots, compressor suction drums, compressor inlet drums, demisters, centrifugal separator, impingement separator, filter separator, and the like. Gas-liquid separation is further described in F. Mueller, "Fundamentals of Gas Solids/Liquids Separation," Mueller Environmental Designs, Inc., Houston, Tex., http://www-.muellerenvironmental.com/res/uploads/media//200-059-GMRC-2004-Separation.pdf, retrieved on Jun. 12, 2018; Chemical Engineers Handbook, Perry et al., 7$^{th}$ ed., © 1997, McGraw Hill Co., Inc.; Handbook of Separation Techniques for Chemical Engineers, P. A. Schweitzer, 3d ed, © 1997, McGraw Hill Co., Inc.

As a result of the gas liquid separation performed in step 120, the separated gas or vapor is withdrawn as a first recycle stream in step 114. This first recycle stream is withdrawn from the partially liquefied composition in a manner to separate the withdrawn gas material from the liquid, which provides a tail remainder stream to be supplied to step 122. The first recycle stream is enriched in C1 and C2 hydrocarbons relative to the partially liquefied feed mixture fed to step 120. The tail remainder stream supplied to step 122 is enriched in C3+ hydrocarbons relative to the partially liquefied feed mixture fed to step 120. In a typical mode of practice, the liquid, tail remainder stream contains 50 to 80 moles of C3+ hydrocarbons per 100 moles of hydrocarbons in the liquid tail remainder stream, more preferably 60 to 75 moles of C3+ hydrocarbons per 100 moles of hydrocarbons in the tail remainder stream. In one exemplary mode of practice, the tail remainder stream includes 70 moles of C3+ hydrocarbons per 13 moles of methane, and 70 moles of C3+ hydrocarbons per 16 moles of C2 hydrocarbons. The composition of the first recycle stream withdrawn in step 114 may include from 1 to 20, preferably 2 to 10 moles of C3+ hydrocarbons per 100 moles of C1 and/or C2 hydrocarbons.

As a result of the gas-liquid separation of step 120, the liquid tail remainder stream is withdrawn and fed to a further gas-liquid separation in step 122. As withdrawn from step 122, the tail remainder stream generally is in a liquid phase. At this stage of processing, the tail remainder stream may be more enriched in C3+ hydrocarbons, but more C1 and C2 material still may be present than is desired. Accordingly, a further gas-liquid separation is carried out in step 122 to remove more C1 and/or C2 content and thereby further purify the liquid material to help provide the heavy hydrocarbon stream 102. To accomplish this, step 122 comprises reducing the pressure of the tail remainder stream. This causes more of the tail remainder stream to vaporize. Generally, the resultant gas is enriched in C1 and C2 hydrocarbons relative to the tail remainder stream as supplied to step 122. Similarly, the liquid is enriched in C3+ hydrocarbons relative to the tail remainder stream as supplied to step 122.

Step 122 further comprises carrying out a gas-liquid separation in order to separate the gas and liquid materials. This allows withdrawing the gas as a second recycle stream in step 116. The liquid can be withdrawn as a depressurized tail remainder stream to incorporate into the purified heavy hydrocarbon stream 102 in the form of the purified NGL. This NGL product stream is enriched in at least one C3+ hydrocarbon relative to the tail remainder stream supplied to step 122. As described above, in some embodiments the purified NGL stream may include 80 to 95 moles of C3+ hydrocarbons per 5 to 20 moles of C1 and/or C2 hydrocarbons.

In the meantime, the separated gas material is withdrawn in step 116 as a second recycle stream that is enriched in at least one of the C1 and/or C2 hydrocarbons relative to tail remainder stream supplied to step 122. In a typical mode of operation, this second recycle stream may still include 10 to 50, or even 15 to 40 moles of C3+ per 100 moles of C1 and/or C2 hydrocarbons. Accordingly, this second recycle stream is then recycled to be incorporated into the feed mixture in step 110 for re-processing. In the practice of the present invention, the second recycle stream is re-processed via recycling to the feed mixture in order to enhance recovery of the purified C3+ hydrocarbons and the purified C1 and C2 hydrocarbons, respectively, from the feed mixture provided in step 110.

As described above, the composition of the light, first recycle stream withdrawn in step 114 may include from 1 to 20, preferably 2 to 15 moles of C3+ hydrocarbons per 100 moles of C1 and/or C2 hydrocarbons. Adsorption separation techniques are used in step 115 to help further purify the light component to help provide the light hydrocarbon stream 104. Step 115 includes using an adsorbent under conditions effective to help separate the first recycle stream to provide a further separated light component in step 117 that is further enriched in the light hydrocarbon components and a first tail stream that is enriched in the C3+ components that can be withdrawn as a separated heavy component in step 119. Step 115 is based at least in part on a principle that C3+ hydrocarbons are selectively adsorbed onto the surface of a suitable adsorbent material when the first recycle stream is caused to contact the adsorbent. Pressure and temperature of the first recycle stream may be independently selected to help enhance the selective adsorption of the C3+ hydrocarbons. Generally, pressures and temperatures can be selected to favor the selective adsorption of the heavy hydrocarbon materials.

One factor contributing to this selective behavior is that the vapor pressures of the heavy hydrocarbon components are distinctly lower than those of the light hydrocarbon components at higher pressures and lower temperatures, making it easier for the adsorption forces to act upon the heavy hydrocarbon components. Also as a general principle, the higher the pressure, the more of the heavy components that are adsorbed at a given temperature. Later, reducing the pressure causes adsorbed material to be desorbed, or released, from the adsorbent. In addition to vapor pressure phenomena, the larger molecules also tend to be more strongly attracted to the adsorbent surfaces via intermolecular interactions.

These adsorption principles allow the heavy and light components of the first recycle stream to be separated in an illustrative pressure swing adsorption (PSA) strategy that comprises a loading or adsorption portion and a regeneration/release portion. In a first adsorption or loading portion, the first recycle stream is caused to contact one or more adsorbent beds comprising one or more adsorbent materials while the first recycle stream is under relatively high pressure at one or more temperatures in a suitable range. In illustrative embodiments, the pressurized first recycle stream may be at a pressure in the range from 50 to 700 psig, preferably 150 to 250 psig and a temperature in the range from 0° C. to 100° C., preferably 10° C. to 60° C. In one mode of practice, a temperature of 27° C. and a pressure of about 230 psig would be suitable.

As the first recycle stream flows through the adsorbent bed(s), the first recycle stream intimately contacts the adsorbent material. The result is that C3+ hydrocarbon material is selectively incorporated onto the adsorbent surfaces in much greater amounts than the C1 and C2 materials are adsorbed. This causes the flowing first recycle stream to become depleted in C3+ hydrocarbons while become enriched in C1 and C2 hydrocarbons relative to the feed mixture supplied to the bed(s). Further, the adsorbed, trapped material tends to be enriched in C3+ material and depleted in C1 and C2 material relative to the first recycle stream. The flowing mixture that is now enriched in C1 and C2 material can be independently withdrawn as a separated light component in step 117 as the adsorption of the heavy material progresses. In exemplary modes of practice, the withdrawn stream of light hydrocarbons may be highly purified with respect to C1 and C2 hydrocarbons while including only a small amount of C3+ hydrocarbons. The result is that the withdrawn light stream may be sufficiently pure for incorporation into the light hydrocarbon stream 104 without further processing, if desired. For example, as withdrawn in step 117, the separated light component may contain less than 5, even less than 3, or even less than 1 mole of C3+ hydrocarbons per 100 moles of C1 and/or C2 hydrocarbons. Optionally, however, the light stream may be further purified or otherwise handled, if desired.

According to a typical PSA process that may be practiced in step 115, the first recycle stream is caused to flow through or past one or more adsorbent beds to allow the first recycle stream to intimately contact the adsorbent material. As this flow continues, the concentration of the adsorbed material tends to gradually decrease. The concentration of adsorbed material in the beds generally is not uniform throughout the bed, particularly on a bed whose adsorbent capacity is well below its saturation point. Instead, the concentration of the adsorbed material tends to be highest toward the upstream end of an adsorbent bed and will tail off gradually downstream through a mass transfer zone in the adsorbent material. As the adsorbing stage continues, the mass transfer zone will progressively move downstream in the adsorbent bed.

The adsorbent bed(s) generally have a large yet limited capacity to adsorb components of the feed mixture. At some point, the adsorbent bed(s) may become saturated and unable to adsorb further material. At and beyond saturation, the first recycle stream generally would tend to flow through the adsorbent bed(s) with too little treatment or even might be unaffected. Accordingly, the flow of the first recycle stream is desirably stopped or redirected to another bed before saturation is reached to help make sure that the first recycle stream is appropriately treated to separate the light and heavy materials in the desired manner. This ends the adsorbing stage with respect to that bed. The bed can then be regenerated in a second processing stage by releasing or desorbing the adsorbed material and withdrawing it separately as the separated heavy component in step 119.

After the flow of the first recycle stream through the adsorbent bed(s) is stopped, the pressure of the beds is reduced to carry out the second or regeneration stage of a PSA process. The pressure drop tends to cause adsorbed materials to be released, or desorb, from the adsorbent bed(s). The temperature may be actively increased, if desired, to enhance release of material from the adsorbent(s), but excellent release generally tends to occur without having to actively adjust the temperature. In the absence of active temperature adjustment, the adsorbent environment may tend to cool on its own accord as the pressure is reduced. This not only regenerates the adsorbent material, but it also allows the released material to be withdrawn in step 119 as the separated heavy component stream that is enriched in C3+ hydrocarbons relative to the first recycle stream. This heavy component stream as taken from the adsorbent bed(s) may still tend to include a substantial amount of C1 and C2 material. The result is that the separated heavy component stream may include too much C1 and/or C2 content to provide a natural gas liquid stream of desired purity. Accordingly, the heavy component withdrawn in step 119 is recycled back to be incorporated into the feed mixture in step 110 for re-processing.

To assist in release and withdrawal of adsorbed material, a purge stream can be flowed through the adsorbent bed(s). Desirably, the purge stream flows in a counter-current fashion relative to the direction in which the first recycle stream flowed through the bed. As one option, a portion of the light component stream withdrawn in step 117, whose concentration of C3+ material is depleted relative to the first recycle stream, can be used as all or a portion of the purge stream. Optionally, other purge materials, such as nitrogen, clean dry air, or the like may be used.

In view of this discussion, a typical PSA system involves two or more vessels to help provide continuous operation. These are operated in a coordinated manner to continuously treat the feed mixture by carrying out the adsorption in at least one vessel while regeneration occurs in at least one other vessel. When the adsorbent media used for adsorption become sufficiently full of adsorbed material, the roles of the vessels are switched so that the regenerated vessel(s) are now used for adsorption while the more full adsorbent media undergo regeneration and release of the adsorbed material. Dual stage PSA (also known as DS-PSA) processes are examples of this strategy in which two adsorbent bed vessels are operated in coordinated fashion to allow continuous processing of feed mixtures. An illustrative embodiment of a DS-PSA system is described in Assignee's co-pending PCT Pat. Pub. No. WO/2018/085076. Examples of PSA systems also are described in U.S. Pat. Pub. No. 2006/0191410; US Pat. Pub. No. 2012/0222552; WO 2015/130339; WO 2015/130338; WO 2015/18333; EP 1811011A1. System 200 described below with respect to FIG. 2 may use a dual-stage PSA system to provide adsorbent separation functionality.

Still referring to FIG. 1, suitable adsorbent materials provide adsorption characteristics to selectively adsorb C3+ hydrocarbons relative to C1 and C2 hydrocarbons. Adsorption generally refers to the adhesion of a material, the adsorbate, onto a surface. Adsorption most commonly involves physical, electrostatic, ionic, magnetic, complexing, and/or similar interactions between the adsorbate and the adsorbing surface. Adsorbents commonly are solids, semi-solids, gels, or the like. Suitable adsorbent materials often operate via not only adsorption phenomena, but optionally also may interact with the feed mixture by one or more other functionalities such as absorption or the like. Accordingly, the term "adsorbent" as used in the present invention refers to materials that incorporate at least but are not limited to adsorbent functionality.

In order to provide a large adsorption capacity, an adsorbent desirably has a relatively large surface area. Desirably, an adsorbent material has porosity characteristics in order to provide large surface area characteristics. In illustrative embodiments, an adsorbent may have a surface area in the range from 100 $m^2/g$ to 2000 $m^2/g$, even 500 $m^2/g$ to 1500 $m^2/g$, or even 1000 $m^2/g$ to 1300 $m^2/g$. In the practice of the present invention, surface area of an adsorbent may be measured as the BET specific surface area.

A wide range of adsorbent materials with suitable surface area and the desired selectivity are available to be used in the practice of the present invention. Examples include one or more of silica, silica gel, alumina, silica-alumina, zeolites, activated carbon, polymer supported silver chloride, copper containing resins, or polymers (such as a partially pyrolized macroporous polymer or macroporous alkylene-bridged adsorbent polymer as described in Assignee's Co-Pending PCT Pat. Pub. No. WO/2018/085076 or in U.S. Pat. No. 9,908,079 B2).

Figure 2:
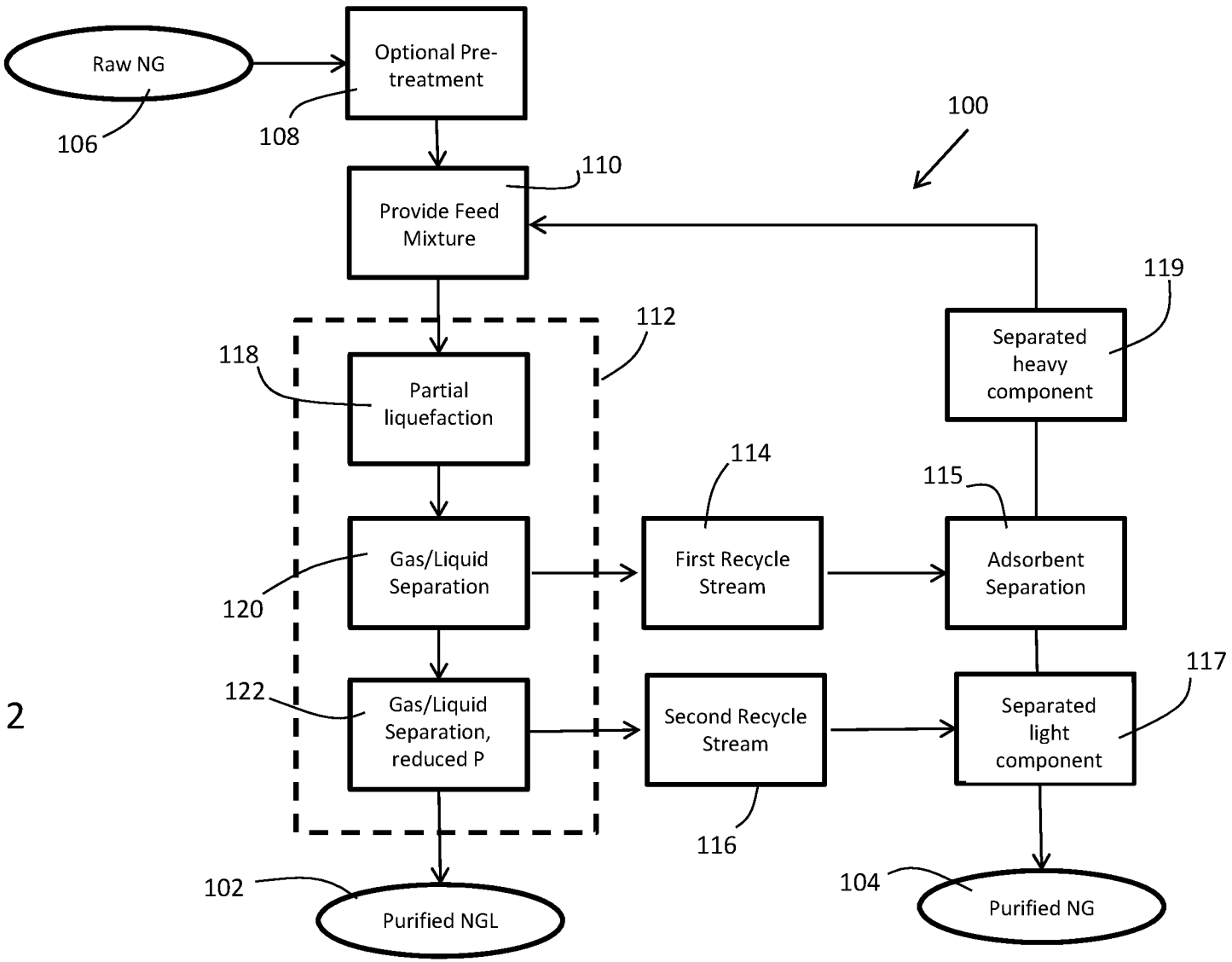
FIG. 2 is a schematic illustration of an alternative embodiment of a method of the present invention useful to separate hydrocarbon feed mixtures into purified light and heavy components, respectively.

FIG. 2 is a schematic illustration of an alternative embodiment of method 100 of the present invention that also is useful to separate hydrocarbon feed mixtures into purified light and heavy components, respectively. In the embodiment of method 100 shown in FIG. 1, the second recycle stream 116 is recycled into the feed mixture in step 110 for re-processing. However, the present invention appreciates that the second recycle stream may be useful in other ways as well. FIG. 2 shows an alternative in which the second recycle stream withdrawn in step 116 is incorporated into the separated light component in step 117 instead. Although the C3+ content of the second recycle stream may be higher than desired for the second recycle stream on its own to serve as a highly purified NG product, the relative flow rate of the second recycle stream relative to the light component obtained from adsorbent separation in step 115 may be sufficiently low such that the purified light hydrocarbon product 104 still remains highly pure, e.g, over 95 or even over 98, or even over 99 mole percent C1 and C2 hydrocarbons based on the total weigh to hydrocarbons in the purified NG product, even after this incorporation.

Figure 3:
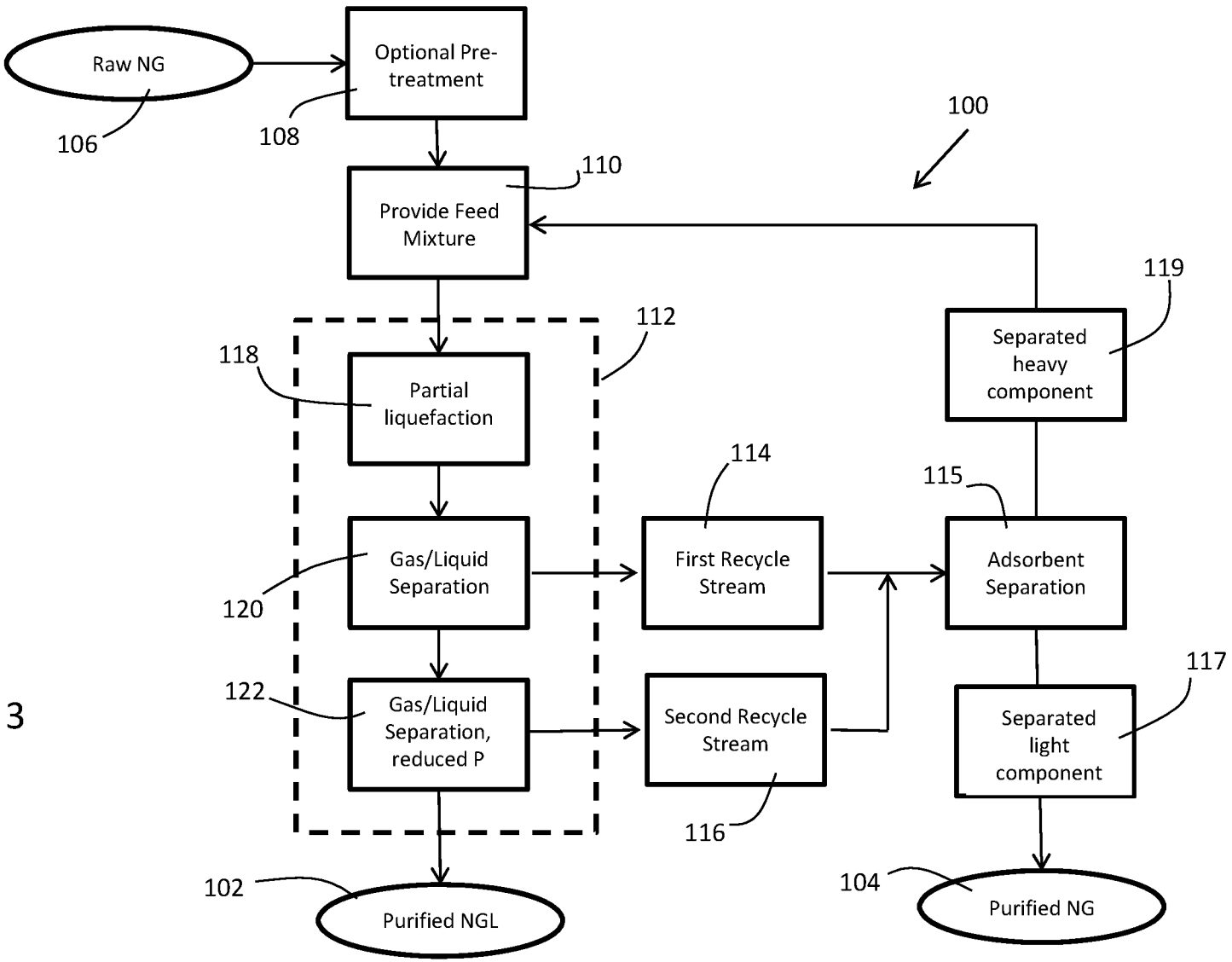
FIG. 3 is a schematic illustration of another alternative embodiment of a method of the present invention useful to separate hydrocarbon feed mixtures into purified light and heavy components, respectively.

FIG. 3 is a schematic illustration of another alternative embodiment of method 100 of the present invention that also is useful to separate hydrocarbon feed mixtures into purified light and heavy components, respectively. In some instances, it may be the case that the C3+ content of the second recycle stream may be higher than desired for direct incorporation into the separated light component in step 117. At the same time, the second recycle stream also may be too dilute in C3+ content to be suitable for incorporation into the feed mixture in step 110. Consequently, FIG. 3 shows a useful mode of practice in which the second recycle stream is combined with the first recycle stream to provide a combined mixture to be used as a feed for the adsorbent separation of step 115. This allows more C1 and C2 material to be recovered into the purified light hydrocarbon product 104 while also allowing more C3+ content to be recovered in step 119 for re-processing.

Figure 4:
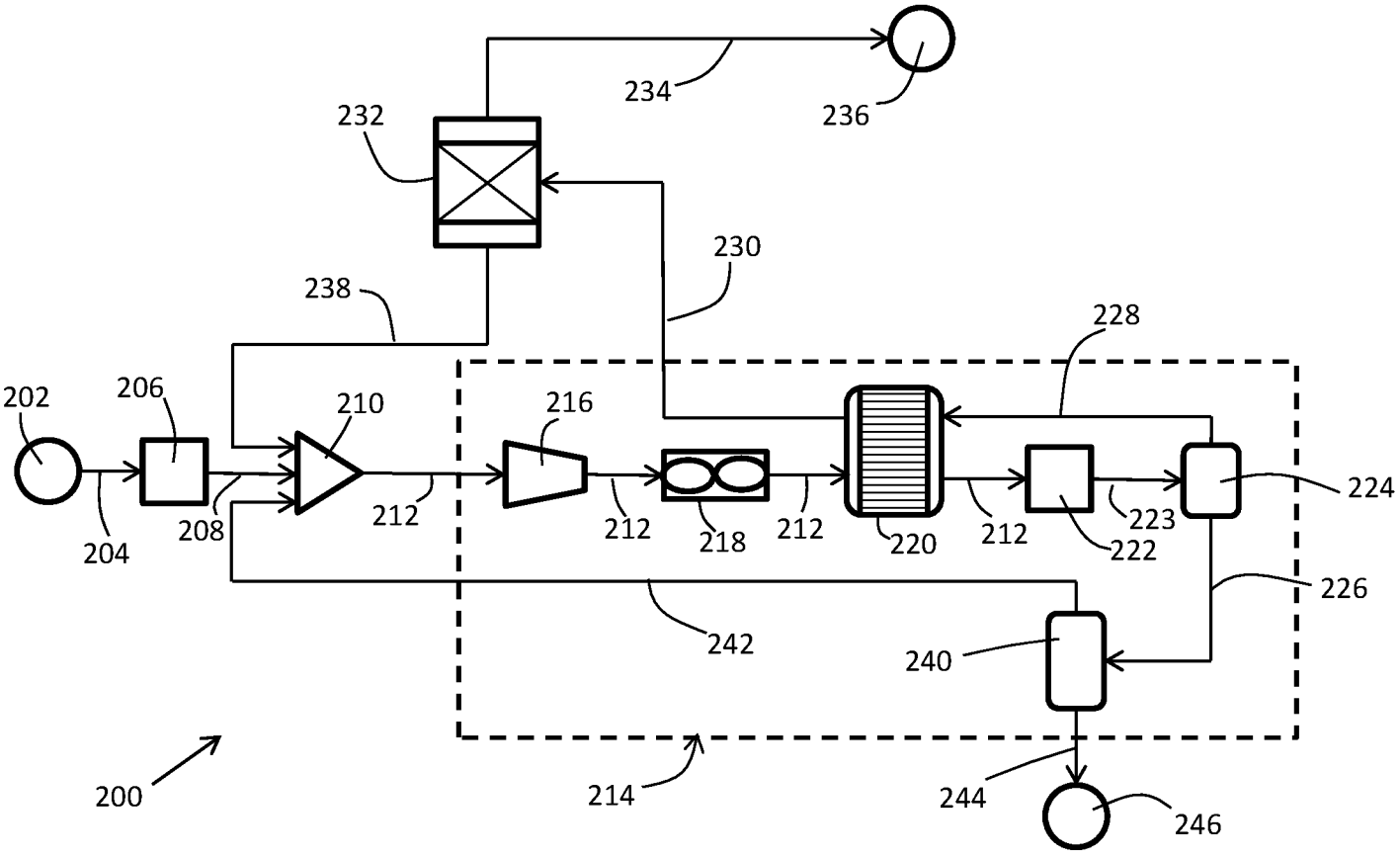
FIG. 4 schematically shows one illustrative embodiment of a system of the present invention useful to separate hydrocarbon feed mixtures into purified light and heavy components, respectively.

FIG. 4 shows an illustrative embodiment of a purification system 200 that can practice the method of FIG. 1 in order to separate C1 and C2 hydrocarbons from C3+ hydrocarbons to provide a purified NGL product 246 and a purified NG product 236. For purposes of illustration, system 200 will be described in the context of accomplishing this separation with respect to raw natural gas that comprises one or more of C1 and C2 hydrocarbons and one or more C3+ hydrocarbons. Accordingly, system 200 is fluidly coupled to one or more sources 202 of such raw natural gas. Line 204 fluidly couples the natural gas source(s) 202 to one or more optional pre-treatment systems 206. Pre-treatment systems 206 may be used to remove one or more contaminants from the raw natural gas. Examples of such contaminants may include one or more of carbon dioxide, water, nitrogen, hydrogen sulfide, mercaptans, mercury, chlorides, helium, or the like. The treated natural gas is then fed by line 208 to mixer 210. Mixer 210 combines the natural gas fed by line 208 with a second recycle stream (described further below) fed to mixer 210 by recycle line 242 as well as a separated heavy component fed to mixer 210 by line 238. The mixer 210 may be a simple juncture at which pipes join, where effective mixes tends to occur as the streams are joined.

The combination of mixed streams in mixer 210 provides a feed mixture that is supplied by a supply conduit pathway in the form of line 212 to liquefaction system 214 in order to provide a more purified NGL product 246 that is more enriched in one or more C3+ hydrocarbons relative to the feed mixture supplied to the liquefaction system 214. Additionally, liquefaction system 214 is used to produce a first recycle stream via lines 228 and 230 and a second recycle stream via line 242 for further processing, respectively.

As an initial stage of processing, liquefaction system 214 includes components that help to pressurize and cool the feed mixture. These components include compressor 216, an air cooler 218, a heat exchanger 220, and a chiller 222 fitted onto line 212. Pressurizing and cooling the feed mixture provides a pressurized and cooled, partially liquefied feed mixture that is discharged from chiller 222 via line 223. A partially liquefied feed mixture desirably is pressurized and cooled under conditions effective to partition the contents of the feed mixture into a gas containing 1 to 20, preferably 2 to 10 moles of C3+ hydrocarbons per 100 moles of C1 and/or C2 hydrocarbons; and a liquid containing 50 to 80 moles of C3+ hydrocarbons per 20 to 50 moles of C1 and/or C2 hydrocarbons, more preferably 60 to 75 moles of C3+ hydrocarbons per 20 to 50 moles of C1 and/or C2 hydrocarbons. Illustrative temperature and pressure ranges are discussed above with respect to FIG. 1. In one mode of operation, pressurizing and cooling the feed mixture as it exits chiller 222 to a pressure of 230 psig and a temperature of −25° C. would be suitable.

As a result of such pressurization and cooling, the liquid phase is enriched with respect to one or more C3+ hydrocarbons relative to the feed mixture supplied to the liquefaction system 214, while the gas phase is enriched in C1 and/or C2 hydrocarbons relative to the feed mixture supplied to the liquefaction system 214. The resultant gas and liquid materials are easily separated for further processing and purification of the respective light and heavy components.

Liquefaction system 214 includes a pressurizing system and a cooling system that in the illustrated embodiment contains at least two cooling stages. Compressor 216 is used to pressurize the feed mixture to a suitable pressure as described above with respect to step 118 of FIG. 1. Compression causes the pressurized material to get hot. Accordingly, the pressurized material is then cooled in two or more stages to achieve the desired degree of partial liquefaction of the feed mixture. For purposes of illustration, liquefaction system 227 is shown as including three cooling stages including air cooler 218, heat exchanger 220, and chiller 222 incorporated into line 212. Cooling in multiple steps this way is more economical overall than trying to refrigerate the pressurized material in a single stage.

The pressurized and cooled feed mixture is directed from chiller 222 to a gas-liquid separator tank 224 along line 223. In many embodiments, this is a simple tank in which liquid under the influence of gravity is withdrawn from a bottom region of tank 224 through line 226 while the gas is withdrawn from a top region of the tank 224 by line 228. The withdrawn liquid provides a tail remainder stream that is enriched in at least one C3+ hydrocarbon relative to the pressurized and cooled, partially liquefied feed mixture fed to tank 224. The withdrawn gas constitutes the first recycle stream that is enriched in C1 and/or C2 hydrocarbons relative to the pressurized and cooled feed mixture fed to tank 222.

As the separated, but cooled gas is conveyed back to the adsorbent system 232 along line 228, its passage through the heat exchanger 220 helps to cool the feed mixture flowing through the heat exchanger 220 along line 212. This second stage of cooling of the feed mixture in combination with the cooling provided by air cooler 218 helps to reduce the refrigeration demand upon chiller 222, making the cooling process more efficient and economical. Desirably, chiller 222 comprises a mechanical refrigeration unit and avoids cryogenic or other technologies that require a reboiler to accomplish a cooling cycle. Thus, chiller 222 may be of the type that does not include an external refrigerant.

The tail remainder stream withdrawn from tank 224 through line 226 tends to be predominantly a liquid and still may include more C1 and/or C2 content than might be desired to provide a purified NGL product 246 having one or more C3+ hydrocarbons of sufficient purity relative to remaining C1 and/or C2 content. In order to further purify this liquid stream, therefore, the stream is subjected to at least one additional gas-liquid separation. However, in order to do this, more of the stream needs to be partitioned into a gas phase. This is accomplished by transferring the tail remainder stream to flash tank 240 via line 236. In the flash tank, the pressure is reduced to cause more of the material to vaporize into the gas phase. As was the case with the tank 224, the gas phase resulting in tank 240 tends to be enriched with respect to C1 and/or C2 hydrocarbons relative to the tail remainder stream supplied to tank 240, while the liquid phase tends to be enriched in one or more C3+ hydrocarbons relative to the tail remainder stream supplied to tank 240.

The resultant gas and liquids are easily separated. Under the force of gravity, the liquid stream, now in the form of purified NGL product 246 is withdrawn from a lower portion of tank 240 via line 244. The gas is withdrawn from an upper portion of tank 240 via line 242 as a second recycle stream. The second recycle stream is recycled back to mixer 210 via line 242 in order to be incorporated into the feed mixture for re-processing.

In the meantime, the first recycle stream withdrawn from tank 224 via line 228 passes through heat exchanger 220 to help cool the feed mixture and then is conveyed to a pressure swing adsorption (PSA) system 232 by line 230. Optionally, a compressor (not shown) may be used on the line 230 in order to pressurize the first recycle stream to a pressure suitable for carrying out adsorption separation strategies in the PSA system 232. As described above with respect to FIG. 1, the first recycle stream may be pressurized to a pressure in the range from 50 to 700 psig, preferably 150 to 250 psig and a temperature in the range from 0° C. to 100° C., preferably 10° C. to 60° C. In one mode of practice, a temperature of 21° C. and a pressure of about 230 psig would be suitable. Pressurizing the feed mixture might involve additional cost to install and run a pressurizing unit (216), but in many instances this cost can be offset by the ability to use a significantly smaller PSA system.

PSA system 232 provides an adsorbent bed system comprising one or more adsorbent beds, wherein each adsorbent bed comprises one or more adsorbents (described above) that selectively adsorb C3+ hydrocarbons relative to C1 and/or C2 hydrocarbons from the first recycle stream. Consequently, adsorption separation techniques may be used by system 232 to help separate the C1 and C2 hydrocarbon content of the first recycle stream from the C3+ hydrocarbon content of the first recycle stream.

To accomplish the separation, PSA system 232 comprises a first configuration in which the first recycle stream is separated into at least one C1 and/or C2 enriched first product stream that is discharged from system 232 via at least one outlet conduit illustrated as line 234. The resultant first product stream is enriched in C1 and/or C2 hydrocarbons relative to the C1 and/or C2 content of the feed mixture supplied to system 232 via line 230. The first product stream generally is a gas and provides at least a portion of the resultant NG product 236. In illustrative modes of practice, the first product stream is at a pressure in the range from 100 to 300 psig, preferably 150 to 250 psig and a temperature in the range from 25° C. to 100° C., preferably 40° C. to 90° C. In one mode of practice, a temperature of 30° C. and a pressure of about 130 psig would be suitable.

A typical PSA system may be used to prepare first product streams, sometimes also referred to in the industry as treated gas streams that are highly pure in C1 and C2 hydrocarbon content while including very little if any C3+ hydrocarbon content. For example, the first product stream may include 80 mole percent to about 100 percent, more preferably about 90 mole percent to about 99.9 mole percent, even more preferably about 95 mole percent to about 99.9 mole percent of C1 and C2 hydrocarbons. In one embodiment, a dual stage PSA system is used to treat a first recycle stream containing 10 mole percent to 20 mole percent of C3+ hydrocarbons. This would provide a first product stream containing less than 1 mole percent of C3+ hydrocarbons.

While system 232 is in the first configuration, portions of the first recycle stream are selectively adsorbed onto at least one adsorbent bed. Due to the selective adsorption properties of the adsorbent material, the adsorbed material is enriched in one or more C3+ hydrocarbons relative to the C1 and/or C2 hydrocarbons in the first recycle stream.

PSA system 232 also comprises a second configuration in which the one or more adsorbed portions of the feed mixture are released from at least one of the one or more adsorbent beds to provide at least one C3+ enriched, first tail stream that is discharged from PSA system 232 via an outlet conduit in the form of line 238. In many modes of practice, the tail stream is discharged via line 238 as a gas stream. The gas stream may be at any suitable temperature and pressure. In a typical mode of practice, the discharged gas stream is at 1 atm and 10° C. The tail stream discharged from the PSA system 232 is supplied to mixer 210 via line 238 in order to be incorporated into the feed mixture.

In some modes of practice, PSA system 232 is in the form of a dual stage PSA system. While at least one vessel adsorbs, at least one other vessel desorbs to regenerate the adsorbent media and release adsorbed material. After a time, the roles are switched so that adsorption and regeneration can occur continuously.

The natural gas product 236 may be flared for disposal but it has many uses such as fuel or the like. Desirably, therefore, less than 10 mole percent, more preferably less than 5 mole percent, or even less than 1 mole percent based on the total composition of the natural gas product 236 is flared or otherwise disposed of without further use, handling, or storage. The natural gas product 236 desirably has a pressure below about 700 psig, preferably below about 500 psig, more preferably below about 300 psig. The natural gas product 236 desirably has a BTU content below about 1150 BTU/scf (Standard Cubic Foot), preferably below about 1050 BTU/scf, more preferably below about 1000 BTU/scf.

Advantageously, most of the C2 content of the feed mixture, e.g., at least 80 mole percent of the C2 content based on the total amount of the C2 content of the feed mixture is recovered in the product 236 so that 20 mole percent or less of C2 content of the feed mixture is recovered in the NGL product 246. By limiting the C1 and C2 content of the purified NGL product 246, the NGL product 246 desirably has a vapor pressure at 100° F. below about 400 psig, preferably below about 300 psig, even more preferably below about 200 psig. Often, the NGL product 246 is at a sufficiently high pressure to exist in predominantly liquid form. The pressure desirably is sufficiently high so that even C2 content in the NGL product 246 is substantially entirely in the liquid phase. To the extent that methane is present in the NGL product 246, it may exist in a gas phase that is dissolved in the liquid.

Practicing the method 100 of FIG. 1 in system 200 of FIG. 4 provides many advantages. The resulting natural gas product 236 is lean in C3+ hydrocarbons and is suitable for power generation and chemicals production rather than being flared for disposal. This ability to eliminate flaring is particularly useful in those many countries that follow the "Zero Routine Flaring by 2030" initiative. The product gas 236 can efficiently be used for power generation due to the low energy content of the gas. Flare elimination can be important as government flaring penalties can be structured in ways that reward flare elimination much more than flare reduction. In addition to eliminating flare equipment, a flare elimination design can reduce the need for additional monitoring, reporting, permitting, and other compliance issues. In parallel, system 200 produces the purified NGL product 246 that is lean in C1 and C2 content. The NGL product 246 can be collected and sold to meet market demand.

The principles of the present invention also use light hydrocarbon production to help improve NGL purification, wherein liquefaction uses multiple stages to purify a heavy component to provide the desired NGL product. As the heavy component is purified in each stage, withdrawn material is recycled or incorporated into product streams. The liquefaction system uses both a high pressure separator as well as a flash tank as separate stages of NGL purification. An initial high pressure liquid-gas separation allows for substantial methane elimination and some C2 elimination from the heavy stream at high pressure while also carrying some C3+ material back to the PSA unit for reprocessing. Additional C2 material and some more C1 material can be further rejected from the NGL stream by utilizing the flash vessel to meet Reid vapor pressure requirements.

Figure 5:
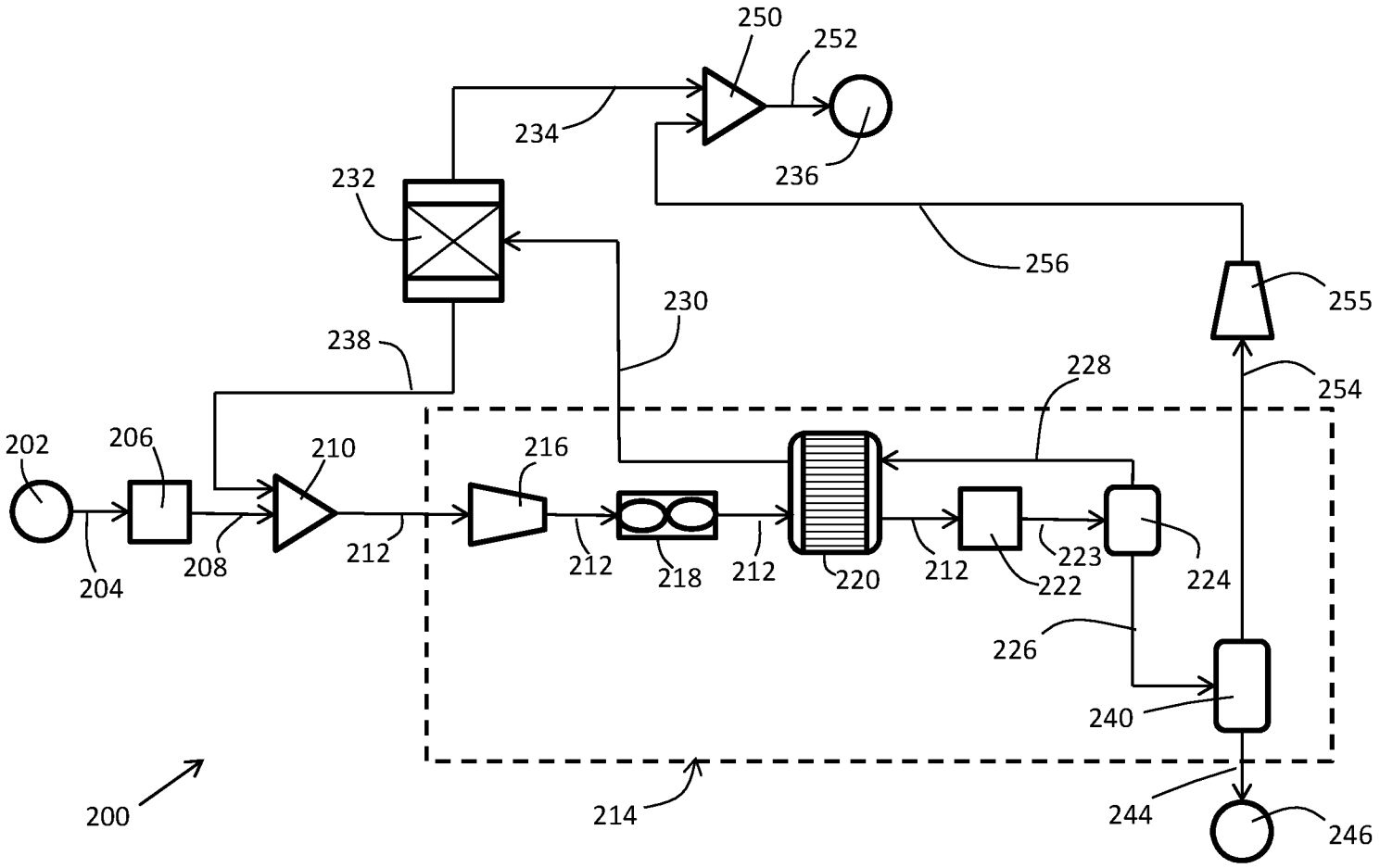
FIG. 5 schematically shows an alternative embodiment of the system of FIG. 4.

FIG. 5 shows schematically shows an alternative embodiment of the system 200 of FIG. 4 that is modified to practice the method of FIG. 2. In this embodiment, the light stream taken from PSA system 232 is fed to mixer 250 via line 234. In the meantime, the second recycle stream withdrawn from tank 240 via line 254 is also fed to mixer 250. Optionally, compressor 255 may be used to pressurize the second recycle stream in order for the pressure of the second recycle stream to more closely match the pressure of the light stream taken from PSA system 232 via line 234. In mixer 250, the two streams from lines 234 and 256 are combined to provide the resultant NG product 236 via line 252.

Figure 6:
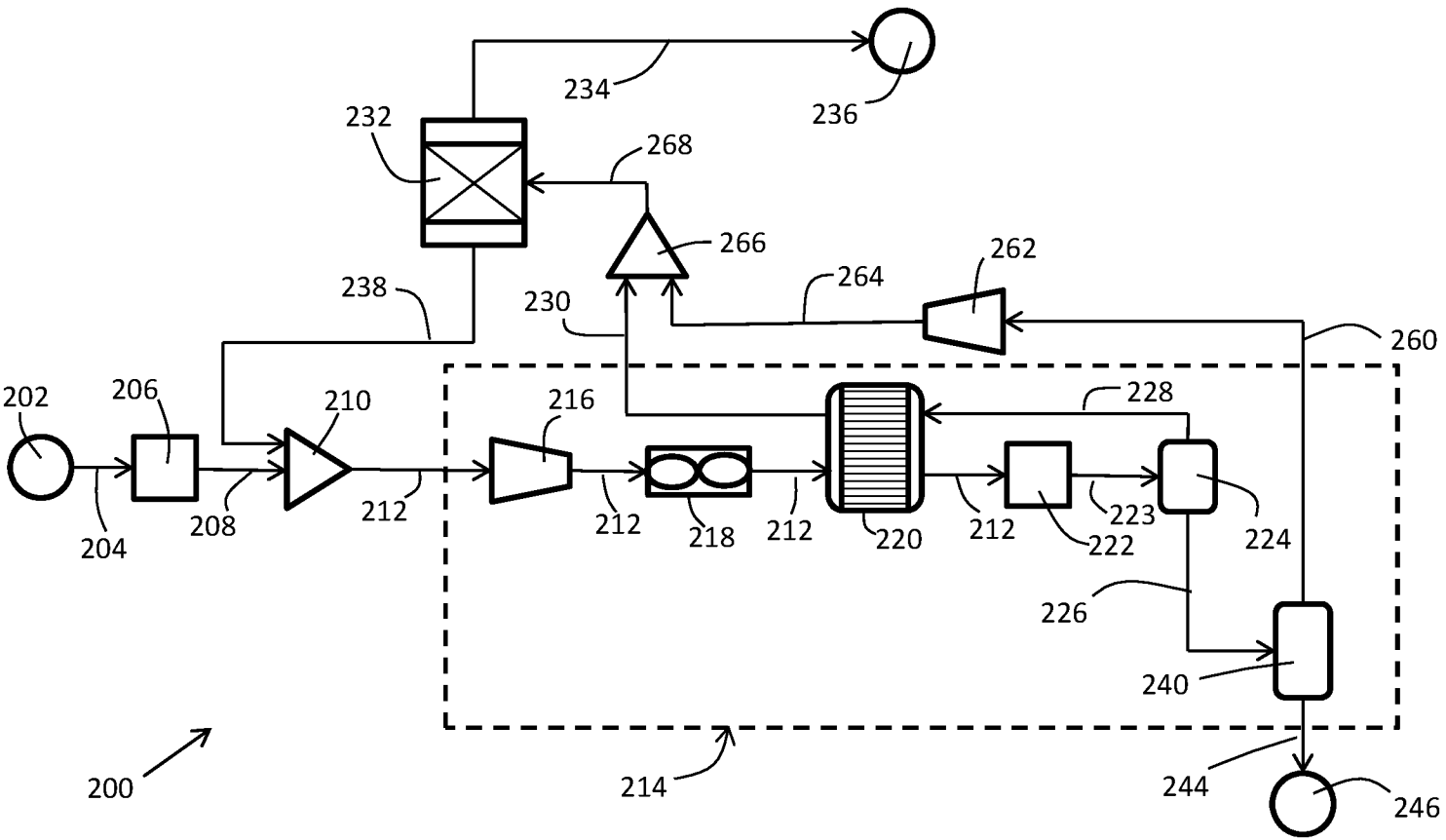
FIG. 6 schematically shows an alternative embodiment of the system of FIG. 4.

FIG. 6 schematically shows an alternative embodiment of the system 200 of FIG. 4 that is modified to practice the method of FIG. 3. In this embodiment, the first recycle stream taken from tank 224 via lines 228 and 230 is fed to mixer 266. In the meantime, the second recycle stream withdrawn from tank 240 via line 260 is fed to a compressor 262 and then to mixer 266 via line 264. At mixer 266, the first and second recycle streams are combined. The combined mixture is fed to the PSA system 232 via line 268.

The present invention will now be further described with reference to the following illustrative example.

Example

This example provides a material balance to illustrate the performance of using the method 100 of FIG. 1 in the system 200 of FIG. 4. The material balance is shown in Table 2 of FIG. 7, wherein the amounts of materials are expressed on a mole percent based on the total moles in the stream. In Table 1, the streams referred to in Table 2 are defined as follows:

TABLE 1

| Stream in Table 2 | Corresponding stream in FIG. 4 |
|---|---|
| Feed | Natural gas fed to mixer 210 via lines 204 and 208 |
| Combfeed | Feed mixture fed to system 214 via line 212 |
| 2 | Compressed feed mixture fed to heat exchanger 220 via line 212 |
| 3 | Feed mixture fed to chiller 222 via line 212 |
| 4 | Pressurized and cooled, partially liquefied feed mixture fed to tank 224 via line 223 |
| 5 | First recycle stream fed to heat exchanger 220 via line 228 |
| 6 | Separated liquid stream fed to tank 240 via line 226 |
| Offgas | Second recycle stream fed to mixer 210 from tank 240 via line 242 |
| PSAFeed | First recycle stream fed to PSA system 232 via line 230 |
| Tail | Heavy tail stream withdrawn from PSA system 232 and fed to mixer 210 via line 238 |
| Product | Product 236 |
| NGL | Product 246 |

The material balance of Table 2 (FIG. 7) shows that the present invention may have a dramatic impact upon parallel recovery of NG and NGL product streams. In Table 2, the amounts of the components are expressed as a mole percent based on the total moles of the listed components. In addition to the efficient two stage separation to purify the feed mixture stream using liquefaction techniques, the present invention also addresses the challenge of incorporating recycle without returning undue amounts of ethane to the PSA system. The high pressure separation provided by tank 224 in the liquefaction system can focus on primarily methane rejection from the heavy stream while the flash separation provided by tank 240 can focus primarily on ethane rejection from the heavy stream. The rejected ethane from the flash separation can be used in multiple ways as shown by the methods and systems of FIGS. 1 to 6. Referring to the results of practicing the method of FIG. 1 in the system of FIG. 4, one advantageous result is a much leaner NG product 236 containing only 0.4 mol % C3+, which results in higher C3+ recovery as product 246. The design in this material balance also is able to recover greater than 99% of C3+ hydrocarbons into the NGL product 246.

All patents, patent applications, and publications cited herein are incorporated herein by reference in their respective entities for all purposes. The foregoing detailed description has been given for clarity of understanding only. No unnecessary limitations are to be understood therefrom. The invention is not limited to the exact details shown and described, for variations obvious to one skilled in the art will be included within the invention defined by the claims.

What is claimed is:

1. A method of separating C1 and/or C2 hydrocarbons from one or more C3+ hydrocarbons, comprising the steps of:

a) providing a feed mixture comprising (i) at least one of C1 and/or C2 hydrocarbons, and (ii) one or more C3+ hydrocarbons;

b) pressuring and cooling the feed mixture to provide a partially liquefied feed mixture comprising a first liquid portion that is enriched in C3+ hydrocarbons relative to the feed mixture and a first gas portion that is enriched in C1 and/or C2 hydrocarbons relative to the feed mixture;

c) using one or more gas/liquid separations to separate the partially liquefied feed mixture into at least one separated liquid portion that is enriched in C3+ hydrocarbons relative to the feed mixture and at least one separated gas portion that is enriched in C1 and/or C2 hydrocarbons relative to the feed mixture;

d) using at least one adsorbent to contact at least one separated gas portion to further separate said at least one separated gas portions contacting the adsorbent into a light component that is enriched in C1 and/or C2 hydrocarbons relative to the separated gas portion contacting the adsorbent and a heavy component that is enriched in at least one C3+ hydrocarbon relative to the separated gas portion contacting the adsorbent;

e) incorporating at least a portion of the heavy component into the feed mixture;

f) incorporating at least a portion of the separated liquid portion from step c) into a natural gas liquid composition that is enriched in at least one C3+ hydrocarbon relative to the feed mixture; and g) incorporating at least a portion of the separated light component from step d) into a natural gas composition that is enriched in one or more C1 and/or C2 hydrocarbons relative to the feed mixture.

2. The method of claim 1, wherein the feed mixture comprises 5 to 40 moles of C3+ hydrocarbons per 80 to 100 moles of C1 and/or C2 hydrocarbons.

3. The method of claim 1, wherein the feed mixture comprises 10 to 35 moles of C3+ hydrocarbons per 80 to 100 moles of C1 and/or C2 hydrocarbons.

4. The method of claim 1, wherein step b) comprises pressurizing and cooling the feed mixture to a pressure in the range from 50 psig to 300 psig and a temperature in the range from −40 C to 15 C.

5. The method of claim 1, wherein step c) comprises separating the partially liquefied feed stream into a separated first liquid portion that is enriched in C3+ hydrocarbons relative to the partially liquefied feed stream and a separated first gas portion that is enriched in C1 and/or C2 hydrocarbons relative to the partially liquefied feed stream, and reducing the pressure of the first liquid portion to separate the first liquid portion into a separated second liquid portion that is enriched in C3+ hydrocarbons relative to the first liquid portion and a separated second gas portion that is enriched in C1 and/or C2 hydrocarbons relative to the first liquid portion.

6. The method of claim 5, wherein the separated first gas portion is used in step d) as at least one separated gas portion that contacts the at least one adsorbent to provide the light component and the heavy component.

7. The method of claim 5, further comprising using the separated second gas portion in step d) as at least one separated gas portion that contacts the at least one adsorbent.

8. The method of claim 6, further comprising mixing the separated second gas portion with the light component.

9. The method of claim 5, further comprising incorporating the separated second gas portion into the feed mixture.

10. The method of claim 6, wherein the separated first gas portion comprises C1, C2, and C3+ hydrocarbons and wherein the separated first gas portion is used in step d) at a pressure in the range from 50 psig to 700 psig and a temperature in the range from 0 C to 100 C in order to selectively adsorb C3+ hydrocarbons onto the at least one adsorbent relative to the C1 and/or C2 hydrocarbons.

11. The method of claim 10, further comprising using a reduced pressure to release selectively adsorbed C3+ hydrocarbons from the at least one adsorbent to be withdrawn as the heavy component.

12. The method of claim 11, further comprising incorporating the heavy component into the feed mixture.

13. The method of claim 8, further comprising pressurizing the separated second gas portion prior to mixing the separated second gas portion with the light component.

14. The method of claim 1, wherein step b) comprises using a separated gas portion of step c) to cool the feed mixture.

15. The method of claim 14, further comprising air cooling the feed mixture prior to cooling the feed mixture with the separated gas portion.

16. The method of claim 1, wherein step b) comprises pressurizing and cooling the feed mixture under conditions such that the first liquid portion comprises 50 to 80 moles of C3+ hydrocarbons per 20 to 50 moles of C1 and/or C2 hydrocarbons.

17. The method of claim 1, wherein step b) comprises pressurizing and cooling the feed mixture under conditions such that the first gas portion comprises 1 to 20 moles of C3+ hydrocarbons per 100 moles of C1 and/or C2 hydrocarbons.

18. A method of separating C1 and C2 hydrocarbons from one or more C3+ hydrocarbons, comprising the steps of:

a) providing a feed mixture comprising (i) at least one of C1 and/or C2 hydrocarbons, and (ii) one or more C3+ hydrocarbons;

b) pressuring and cooling the feed mixture to provide a partially liquefied feed mixture comprising a first liquid portion that is enriched in C3+ hydrocarbons relative to the feed mixture and a first gas portion that is enriched in C1 and/or C2 hydrocarbons relative to the feed mixture;

c) at least partially separating the first liquid portion from the first gas portion to provide a separated first liquid portion and a separated first gas portion;

d) reducing the pressure of the separated first liquid portion to further separate the separated first liquid portion into a second liquid portion that is enriched in C3+ hydrocarbons relative to the separated first liquid portion and a second gas portion that is enriched in C1 and/or C2 hydrocarbons relative to the separated first liquid portion;

e) using at least one adsorbent to further separate the separated first gas portion into a light component that is enriched in C1 and/or C2 hydrocarbons relative to the separated first gas portion and a heavy component that is enriched in at least one C3+ hydrocarbon relative to the separated first gas portion;

f) incorporating at least a portion of the heavy component from step e) into the feed mixture; and g) incorporating at least a portion of the separated second liquid portion from step c) into a natural gas liquid composition that is enriched in at least one C3+ hydrocarbon relative to the feed mixture; and h) incorporating at least a portion of the separated light component from step c) into a natural gas composition that is enriched in one or more C1 and/or C2 hydrocarbons relative to the feed mixture.

19. A system for separating C1 and/or C2 hydrocarbons from one or more C3+ hydrocarbons, comprising:

a. a source comprising a feed mixture, wherein the feed mixture comprises (i) one or more C1 and/or C2 hydrocarbons; and (ii) one or more C+ hydrocarbons;

b. a liquefaction system fluidly coupled to the source in a manner such that the feed mixture is supplied to the liquefaction system, wherein the liquefaction system is configured to separate the feed mixture into at least one separated liquid portion that is enriched in C3+ hydrocarbons relative to the feed mixture and at least one separated gas portion that is enriched in C1 and/or C2 hydrocarbons relative to the feed mixture;

c. an adsorbent bed system comprising one or more adsorbent beds, each adsorbent bed comprising one or more adsorbents that are caused under pressure to selectively adsorb C3+ hydrocarbons relative to C1 and/or C2 hydrocarbons from a flowing stream comprising C1 and/or C2 hydrocarbons and C3+ hydrocarbons, wherein the adsorbent bed system comprises:

i. a first configuration that occurs under a first pressure such that the flowing stream is separated into at least one C1 and/or C2 enriched output stream while one or more C3+ enriched portions of the flowing stream are selectively adsorbed onto at least one adsorbent bed; and ii. a second configuration occurring under a reduced pressure relative to the first pressure such the one or more adsorbed C3+ portions of the flowing stream are released from at least one of the one or more adsorbent beds to provide at least one C3+ enriched tail stream;

d. a first pathway that couples the liquefaction system to the adsorbent bed system in a manner such that the liquefaction system is upstream from the adsorbent bed system and such that at least a portion of at least one separated gas portion is supplied from the liquefaction system to the adsorbent bed system; and e. a second pathway that couples the adsorbent bed system to the liquefaction system in a manner such that the adsorbent bed system is upstream from the liquefaction system and such that at least a portion of the at least one C3+ enriched tail stream is incorporated into the feed mixture supplied to the liquefaction system.

* * * * *